United States Patent [19]

Heck

[11] 4,288,956

[45] Sep. 15, 1981

[54] INSULATING-SLABS AND THEIR USE

[76] Inventor: Friedrich Heck, Heckenpfad 15, Bad Dürkheim, Fed. Rep. of Germany

[21] Appl. No.: 20,509

[22] Filed: Mar. 14, 1979

[30] Foreign Application Priority Data

Nov. 24, 1978 [DE] Fed. Rep. of Germany ..... 2850861

[51] Int. Cl.[3] ..... E04B 1/62; E04C 2/22; E04B 1/80; E04F 13/04

[52] U.S. Cl. ..... 52/309.12; 52/743

[58] Field of Search ..... 52/309.4–309.12, 52/453, 743; 428/158, 163, 167, 310, 315

[56] References Cited

U.S. PATENT DOCUMENTS 3,389,518 6/1968 Horbach ..... 52/309
4,044,520 8/1977 Barrows ..... 52/453 X

FOREIGN PATENT DOCUMENTS 1509126 5/1969 Fed. Rep. of Germany ..... 52/309.8
2448943 5/1976 Fed. Rep. of Germany ... 52/309.12
2623355 12/1977 Fed. Rep. of Germany ..... 52/309.8
2240325 4/1975 France ..... 52/309.12

*Primary Examiner*—J. Karl Bell
*Attorney, Agent, or Firm*—Berman, Aisenberg & Platt

[57] ABSTRACT

Freshly-formed hard-foam plastic slabs which are preferably susceptible to maximum shrinkage are used as a base for insulating masonry structures. Each slab is grooved and has raised portions (lands) between adjacent grooves. Fastening elements (pins) are dispersed over the grooved surface to secure a reinforcing web to the slab and maintain it at a substantially uniform distance therefrom. To insulate a masonry structure, such as a wall, the face of the wall is covered with such slabs, which are secured to the wall. The exposed surface of the slabs is then plastered with a material which permits the passage of water vapor therethrough. The applied coating of plaster fills the grooves on the slab surface and is thick enough to cover the reinforcing web. A suitable finish coat of plaster or paint is optionally placed over the initial reinforced plaster coating.

29 Claims, 2 Drawing Figures

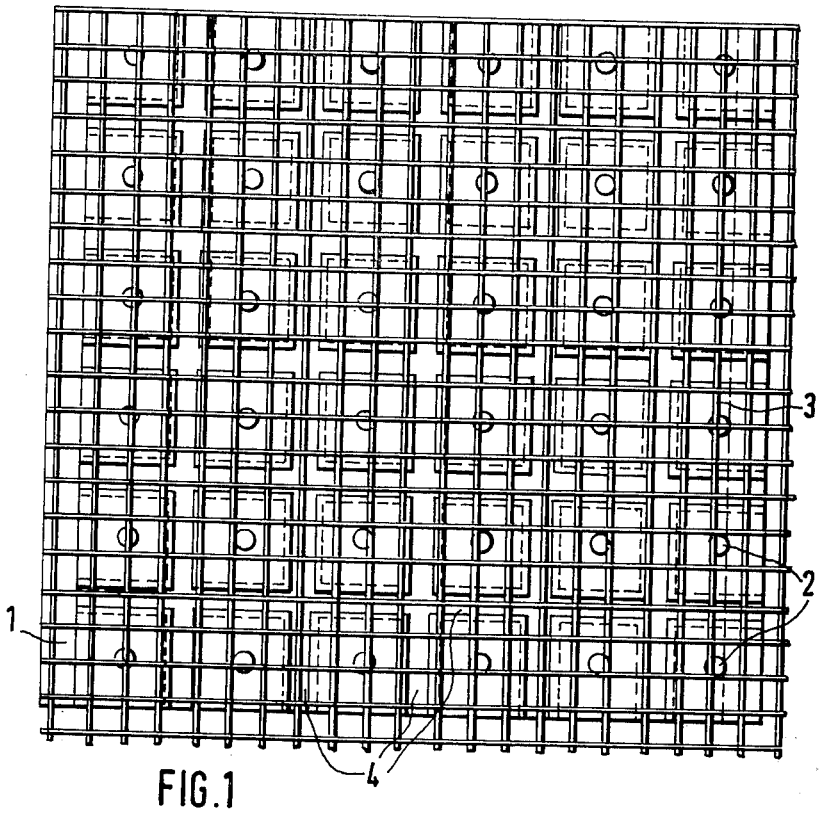
FIG.1
FIG.2
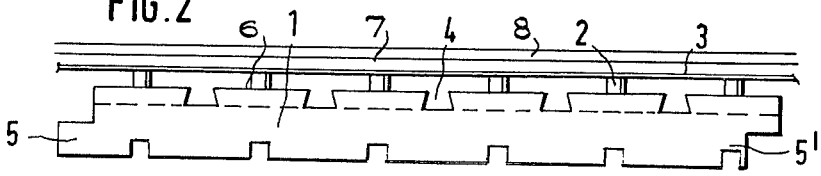

INSULATING-SLABS AND THEIR USE

RELATED APPLICATION

This application is closely related to an application Ser. No. (20,508) directed to THERMAL INSULATION FOR BUILDINGS of the same inventor which is being filed on the same say as the present application. The entire disclosure of the related application is incorporated herein by reference.

TECHNICAL FIELD

Insulating-slab elements are used in the contruction of, e.g., insulated plaster facades for buildings.

BACKGROUND

With increasing frequency insulating layers are applied to outside walls, and such layers are subsequently spackled or plastered. The layers are formed from, e.g., sheets, plates or blocks (hereafter: slabs), generally from 20 to 30 millimeters (mm) in thickness, of a plastic material, such as polystyrene hard foam or polyurethane hard foam.

Because of the very high thermal-expansion coefficient of polyurethane hard foam and the attendant movements brought about by temperature changes, plaster coatings are frequently cracked or torn open at points or areas of contact between the plaster and such hard-foam insulation. When, e.g., polystyrene hard-foam slabs are used, as is the case in many buildings, cracks readily form in the plaster coating over the contact surface and particularly at the juncture between insulating slabs, especially at those places where thicker insulating layers or fresh polystyrene hard-foam slabs are used.

Due to the increasing cost of heat energy, insulating-material thickness of at least about 30 mm are required. Today, an insulating-material thickness of about 70 mm is generally considered to be optimum. For electrically-heated buildings, the optimum figure may even be as high as 180 mm. For such thick insulating layers polystyrene hard-foam slabs, which are smooth on both sides, are unsuitable because forces developed at the interface between the slabs and plaster coating thereon become so great that they exceed the physical limits of the plaster. The insulating slabs are subjected to inherent movement due to shrinkage, as well as to expansion and contraction with increasing and decreasing temperatures. The leads to excessive stress on the plaster coating, particularly that which is over joints between slabs.

The use of grooved hard-foam slabs provides a larger contact surface and results in stronger adherence between the slabs and mortar applied thereto. The adherence is enhanced by the mortar which enters the grooves and thus forms a further interlock with the slabs. Unfortunately, the adverse effects of shrinkage are retained. Such shrinkage is reduced by storing the slabs for an extended period of time prior to use. Such extended storage tends to minimize residual follow-up shrinkage. When the preliminary storage time is insufficiently-long, damage from such shrinkage cannot be avoided and is merely postponed. Storage times of about six months are now customary.

INVENTION

Hard-foam plastic slabs are provided with plural grooves. Spacers or fastening elements are fixed to lands between such grooves and to reinforcing web or fabric to maintain such reinforcement at a substantially fixed distance from the lands.

A wall is covered with such reinforcement-covered slabs, and plaster or mortar having only a small amount of or no synthetic plastic components is applied to the slab and web surfaces. After the plaster or mortar sets and provides a firm and integral structure with the plastic slabs and reinforcing web, the surface is optionally plastered or painted to produce a finished product.

BRIEF DESCRIPTION OF DRAWINGS

FIG. 1 is a plan view of a slab and reinforcing web.

FIG. 2 is an end view of the slab of FIG. 1 covered with plaster and having a finish coating.

DEFINING TERMS

Throughout the specification a number of terms are repeatedly used. Unless otherwise indicated, the following terms are employed as defined.

slab—a sheet, plate or block of hard-foam plastic, e.g. polystyrene, polyurethane or even thermoset phenol/formaldehyde polymer, which has two major surfaces and, ordinarily, four sides or edges (ends). One of the major surfaces is substantially planar (it may have groves, as indicated in FIG 2, but is referred to herein as planar); the other has plural grooves and lands between adjacent grooves. The grooves are preferably milled or otherwise cut into the other surface; they are advantageously undercut in dove-tail fashion. The slab is, e.g., band-foamed or molded to a density of, e.g., from 1 to 3 pounds per cubic foot. It has a follow-up shrinkage which is suitably at least 1 mm/m and preferably the maximum possible. The ends are optionally rabbetted for firm placement in juxtaposition. The slabs are preferably square, having edges from 50 to 250 centimeters in length, and are usually from 1 to 30 centimeters in thickness.

fastening elements—pins, spacers, dots or slugs having a base and a head end. The base is secured to the other surface of the slab, and the head end is secured to a reinforcing web. The fastening elements maintain the web at a substantially uniform distance from the other suface of the slab. They are composed of adhesive, noncorroding metal or plastic.

reinforcing web—a fabric of, e.g., glass fiber, animal hair, sisel and/or synthetic fibers to reinforce the vapor-pervious layer of plaster or mortar applied directly to the other surface of the slab.

plaster or mortar—alternative terms for the same compositions, ordinarily containing from 5 to 20 percent by weight of cement, from 70 to 90 percent by weight of sand, from 0 to 20 percent by weight of plastic and substantially the rest of water.

synthetic-plastic-component-poor plaster or mortar—material applied to the other surface of the slab and which (after setting) permits passage of water vapor therethrough. When set, it preferably has a water-vapor-diffusion-resistance factor ($\mu$) within the range of from about 15 to about 25. The composition contains from 0 to 2.5 or 3.0, preferably from 0.5 to 1.5, percent by weight of plastic components. A suitable plaster composition contains from 5 to 20, e.g. 12 percent of cement, from 70 to 90, e.g. 73, percent of sand, from 0 to 10 e.g. 0.7, percent of chalk, from 0 to 2, e.g. 0 to 0.2, percent of methylcellulose, from 0 to 3, e.g. 0 to 2.2, percent of polyvinylpropionate and water to 100 percent, all percentages being by weight. The surface of the set and dried material is optionally dyed.

outer coat—any suitable coating material, e.g. mineral paint, synthetic-plastic-component-containing dispersion paint or hydraulically-setting plaster with or without synthetic-plastic components.

synthetic plastic—any suitable polymer with adhesive properties, e.g. methylcellulose, a homopolymer or copolymer of acrylic acid or methacrylic acid, e.g. polystyrolacrylate, or polyvinylacetate, preferably a polymer in water-dispersible form.

DETAILS AND BEST MODE

When hard-foam plastic insulating slabs are coated with plaster having a high content of sythetic plastic components, the resulting plaster mass softens under the influence of heat. Even when minor amounts of cement are added to the plaster, it yields, particularly in areas adjacent to joints between slabs.

With increasing and decreasing temperatures material fatigue develops in the plaster near joints. Reinforcing glass-fiber fabric, embedded in the plaster coating mass, becomes brittle from the alternating tension and compression to which it is subjected; it consequently loses its resistance.

The thicker the insulating layer of hard-foam slabs, the greater the shrinkage, the greater the expansion and contraction forces, and the greater the heat buildup in the plaster coating (in view of the increased insulating effect of the hard-foam slab). The totality of the previously-noted effects results in an increased formation of cracks in the plaster coating in the area in which the plaster contacts the hard-foam slab. There is also expected separation between the surface of the hard-foam slab and the plaster mass which contacts it. Bars of plaster coating which form in slab grooves also tend to shear off.

When insulated-plaster facades are preserved by placing glass-fiber fabric on, e.g., polystyrene hard-foam slabs and applying the plaster to them, a relatively large percentage (5 percent or more) of synthetic-plastic components are incorporated in the plaster to impart a sufficient adhesion force to it. Unfortunately, the synthetic-plastic components severely restrict the passage of water vapor through the plaster coating. Water condensed from moist air inevitably penetrates into the interface or boundary area between the hard-foam slab and the plaster. When the plaster contains a relatively large proportion of synthetic-plastic components, the resulting plaster has a blocking effect, precluding the passage of water through it. Such plaster is thus forced away from the slab. Subsequent frost damages the insulated plaster facade.

By using such synthetic-plastic components as poly(-butadiene/styrene), the synthetic-plastic components of the plaster or mortar were reduced to 2.5 percent by weight. Since such plastic components, however, impart a considerably-higher water-vapor blocking value to plaster or mortar compositions than traditional synthetic-plastic substances, their use does not lead to satisfactory results. It is thus necessary either to reduce the synthetic-plastic components of the mortar or plaster even further or to eliminate such component altogether.

The present invention is based on a novel slab secured to a reinforcing web, the use of such a slab in preparing insulated plaster facades and the resulting facades. With reference to the drawings, a hard-foam slab (sheet, plate or block prepared from a synthetic plastic, such as polystyrene or polyurethane) 1 is provided with grooves 4 (preferably by milling) in one surface. In practice both major surfaces can actually be similarly grooved. Fastening elements 2 are placed on lands 6 between grooves 4. The fastening elements 2 act as spacers to maintain a reinforcing web 3 of, e.g., glass-fiber fabric at a substantially-fixed distance from lands 6. The respective opposite ends of each slab are rabbetted so that such ends will overlap or underlay corresponding portions of adjacent slabs, as indicated at 5, 5'.

A plaster or mortar composition 7 is applied to the slab face, incorporating the reinforcing web 3, as seen in FIG. 2. When this layer has set, a further finish plaster and/or paint 8 is optionally applied thereto.

To insulate a wall, whether of wood, stone, brick or other material, the wall is faced with the hard-foam slabs 1 placed in juxaposition over, e.g., substantially the entire surface. The slabs affixed to a wall with adhesive, mortar, and/or nails or other fasteners. A coating of plaster which permits water vapor to pass therethrough is placed over the entire outer grooved surface thus formed. After the plaster sets, mortar and/or paint is optionally applied thereto to form a finish coat.

To prepare the individual slabs, grooves 4 are preferably milled (rather than molded) into one surface. These grooves are advantageously in dove-tail form. On lands 6 between adjacent grooves, spacers (fastening elements) 2 are placed to secure a reinforcing web 3 to the hard-foam slab 1 and to maintain such web at a substantially fixed distance from the face of the slab 1.

Fastening elements 2 are preferably distributed in a substantially uniform fashion over the surface of the hard-foam plate to support the web, e.g. glass-fiber fabric, at a distance of from about 1 to about 2 mm from the slab surface. The plaster 7, which is applied to the slab surface after the reinforcing web is attached, contains little or no synthetic-plastic components so that the resulting insulated facade will present a minimum barrier to the passage of water vapor therethrough.

A novel feature of this invention is the resulting insulated facade with optimum water-vapor-passage values.

The plaster or mortar applied to the hard-foam surface advantageously contains from 0 to 1.5 percent by weight of synthetic-plastic components. By maintaining such a small proportion of such components, water vapor has virtually no negative effect on the resulting insulated facade. The synthetic-plastic ingredients (limited to at most about 1.5 percent of the compositions of the plaster applied to the hard-foam surface) are incorporated into the plaster to make it easier to process and apply in a relatively-thin plaster coating; the synthetic-plastic components are not included in the plaster composition to impart adhesion (after setting) properties thereto.

According to one embodiment dots or slugs of mortar (containing a large proportion of synthetic-plastic components) are distributed over the surface of the slabs, as indicated by 2. These dots or slugs act, when set, to secure an insulating web to the face of the hard-foam slab and at a substantially fixed distance therefrom. By using a high proportion of synthetic-plastic components in this mortar, good adhesion is obtained and the hardened or set slugs of such mortar act as spacers and retain the reinforcing web in a fixed position. The high-plastic-component mortar is thus limited to small zones distributed over the entire surface of each slab, and the main plaster coating is substantially free from synthetic components.

The adhesive slugs or dots of synthetic-plastic-component-containing mortar have effective adhesion surfaces in the order of magnitude of between 20 and 2,000 $mm^2$ prior to setting. The reinforcing web, e.g. glass-fiber fabric, is placed in contact with such dots or slugs immediately after they are applied to the hard-foam surface and before they set.

Appropriate synthetic-plastic-rich mortar (from which the dots or slugs are prepared) suitably has a composition: 10 to 80 (preferably 40 to 60) percent by weight of cement, 0 to 80 (preferably 30 to 50) percent by weight of sand, quartz sand or other mineral filler, and from 2 to 50 (preferably from 5 to 25) percent by weight of synthetic-plastic components. Whenever synthetic-plastic components are referred to, they include any one or a combination of, e.g., methyl cellulose, polyacrylate, polymethacrylate, copolymers of acrylate or methacrylate, such as polystyrol acrylates, polyvinyl acetates and their copolymerizates. Adhesive based on each of these components are known and, per se, do not comprise the invention to which this application is directed. Virtually all known adhesives of any one or combination of these components are suitably incorporated as the synthetic-plastic component of plaster or mortar referred to in this disclosure.

The slugs or dots of synthetic-plastic-containing mortar are permitted to set after the reinforcing web is placed in contact therewith. Only thereafter is the plaster (substantially free of synthetic-plastic components) applied to the slab surface. Quite surprisingly, the applied synthetic-plastic-poor plaster (which has virtually no adhesive effect) is sufficiently held in place by the reinforcing web, e.g., of glass-fiber fabric. The plaster is applied to slabs placed in juxtaposition over the surface of a wall and thus in a perpendicular arrangement. The slabs are suitably preliminarily attached to the wall surface to be insulated.

The best interconnection (after applied plaster has set) between the grooved slabs and plaster applied directly thereto is achieved when hard-foam slabs having a maximum following-up shrinkage are used. It is thus advantageous to use slabs which are freshly prepared and thus contain a high proportion of propellant or solvent in their composition. According to what was previously recognized standard procedure, such slabs must be stored for at least three months to reduce such follow-up shrinkage as much as possible prior to use. The present invention thus has a further advantage of eliminating such storage time.

Another advantage is that the individual slabs with attached reinforcing web are readily prepared at a manufacturing plant. This was not possible with previous counterparts for which the reinforcing web had to be applied to insulating hard-foam slabs which had already been attached to a masonry wall which was being insulated. In such previous counterparts it was essential that, e.g., glass-fiber fabric did not contact slab surfaces along their edges, since such would inevitably lead to the formation of cracks along such edges within a short period of time. Such does not present any problem with the presently-disclosed method, wherein contact surfaces of the reinforcing web can coincide with contact-surface edges of the hard-foam slabs without any crack formation. This is extremely surprising in view of the fact that slabs, having a high degree of follow-up shrinkage, are employed and there was thus every expectation of having an increased incidence of cracking brought about in this manner.

The present hard-foam slabs are thus readily manufactured with reinforcing webs having an identical surface or one which protrudes over the edges only to a minor extent. The slabs are readily attached to a wall because there is no need for any major overlap of the reinforcing web and such overlap can even be entirely omitted.

To assist in the retention of wet plaster to slab contact surfaces, fastening elements, such as slugs or dots 2, are arranged close to preferably from 1 to 10 centimeters from, the edges of each slab.

If necessary or desirable under particular conditions, it is also possible to attach the reinforcing web to the hard-foam slabs at a construction site. Under such circumstances, the web need not be separately attached to each individual plate as previously indicated; a larger reinforcing web is optionally attached to a more extensive portion of the wall to which numerous hard-foam slabs have previously been applied. Under such circumstances, the adhesive mortar dots or slugs are advantageously replaced by alternative fastening elements, which are fixed in stud fashion to the hard-foam slabs and consist of noncorroding metal or plastic. Such fastening elements are affixed to the slab surface and to the reinforcing web in any suitable conventional manner. They are, e.g., merely pressed into the hard-foam slab or adhered thereto in any other convenient manner. They optionally have hooks of some sort on one end to engage the reinforcing web. The specific configuration of such fastening elements is not, per se, critical to this invention.

As previously noted, it is advantageous to mill the grooves into the surface of the slabs after the slabs are made rather than molding the grooves on the surface of the slabs while the latter is being prepared. Needless to say, the two types of resulting slabs are not the same since the surface produced by milling a hard-foam structure has a far different surface make-up than a molded surface. A molded surface generally has a smooth skin which is destroyed by milling grooves therethrough.

When the hard-foam slabs are prepared by molding, they have a compacted surface which was previously referred to as a skin. When molding is effected without using a mold-release agent or other mold-separating means, the resulting molded slabs more-readily adhere to plaster applied to their surfaces. The adhesion of synthetic-plastic-poor plaster or mortar to the hard-foam-slab surface is materially reduced by the use of mold-separation means during the preparation of the hard-foam slabs.

When the slabs are prepared by foaming plastic in the form of a band (formed continuously in an extrusion type mold), the resulting material has greater density and thus improved strength properties over the surface areas, i.e. the area in which the grooves are made. As such slabs have a lower density in their inner portions, they result in having a better balance of tensions, which are shifted into the center of such slabs.

Even an extremely small proportion of synthetic-plastic components in the composition of the plaster or mortar applied to the slab surface provides a coating on the hard foam which, after setting, presents a particularly good foundation for additional (outer) coats of plaster or paint based purely on a mineral composition. When a finish coat is placed over the reinforced plaster coating, adhesion between the two coats is very good in view of the porosity of the synthetic-plastic-poor plaster and the similarity between the compositions of the two coating masses.

The proportion of synthetic plastic components in cement-mortar mixtures has virtually no influence on the thermal (heat expansion) coefficient of the resulting set product.

After plaster or mortar (with little or no synthetic-plastic components) has been applied to the slab surface and a coating (including the reinforcing web) has been formed thereon and permitted to set, a synthetic-plastic-modified mineral outside plaster, a synthetic-plaster component dispersion plaster and/or coats of paint are optionally applied to the outer surface. Any difference in heat-expansion coefficient between the initial reinforced-plaster coating (applied directly to the slab surface) and the synthetic-plastic-component-containing dispersion or other plaster and/or paint does not have a significant disadvantageous effect because the higher expansion coefficient brought about by the presence of synthetic-plastic components is balanced out by the elastic character of the resulting plaster coating.

As compared with the use of a synthetic-plastic-component dispersion plaster or synthetic-plastic-component-containing facade paint as an outer coating, mineral-based plaster or coats of paint are advantageously employed since they readily permit passage of water vapor and do not change in color and other properties over extended periods of time. Synthetic-plastic-component-containing dispersion paints become dirty from increased electrostatic charging; with the passage of time they become brittle from decomposition resulting from ultraviolet radiation and separate from their base because of their increased resistance from water vapor diffusion. Moreover, they are softened by direct sun radiation. Such softening is known to lead to the formation of vapor bubbles which disappear at night on subsequent cooling; the repeated formation and disappearance eventually results in a porous and cracked structure. The water-vapor-diffusion-resistance factors of commercially-available outside coatings are as follows:

Outside plaster with only mineral components: $\mu=10$ to 20

Synthetic-plastic-component-modified mineral outside plaster: $\mu=15$ to 25

Synthetic-plastic-component-containing dispersion plaster: $\mu=100$ to 500

Synthetic-plastic-component-containing dispersion paint: $\mu=500$ to 1000

After the insulating slabs have been glued on or otherwise affixed to a wall which is to be insulated, the synthetic-plastic-component-modified plaster or cement-mortar is applied and smoothed by hand or by a mortar spray machine. This coating is optionally dyed, left in this state, coated with customary plaster or painted.

INDUSTRIAL APPLICABILITY

This invention makes it possible to insulate, e.g., masonry or wood walls in a manner which minimizes on-site operations and maximizes the sturdiness and lasting qualities of the provided insulation. Advantage is taken of the shrinkage properties of freshly-prepared hard-foam plastic in producing an integral reinforced insulation.

The invention and its advantages are readily understood from the preceding description. The several components, the process and the obtained product are subject to various changes without departing from the spirit and scope of the invention or sacrificing its material advantages. The components, the process and the products described herein are merely illustrative of preferred embodiments of the invention.

What is claimed is:

1. A hard-foam plastic slab having two major surfaces, one of which has:

(a) plural grooves and lands between adjacent grooves, (b) fastening elements which have a base and a head end and also serve as spacers, which are secured at their bases to the lands and are dispersed at intervals over the one surface, and (c) a reinforcing web affixed to the head ends of the fastening elements at a substantially uniform distance from said one surface.

2. A slab according to claim 1 having a follow-up shrinkage of more than 1 millimeter per meter.

3. A slab according to claim 2 wherein the grooves are milled or otherwise cut into the one surface.

4. A slab according to claim 3 which is made of polystyrene.

5. A slab according to claim 3 wherein the fastening elements consist of synthetic-plastic-component-rich mortar or other adhesive.

6. A slab according to claim 3 wherein the reinforcing web is a glass-fiber fabric.

7. A slab according to claim 6 wherein the fastening elements space the glass-fiber fabric at an interval of from 1 to 2 millimeters from the one surface.

8. A slab according to claim 7 wherein the grooves are undercut in dove-tail fashion.

9. A slab according to claim 7 wherein the hard-foam plastic slab is of band-foamed material.

10. A slab according to claim 7 having rabbetted ends for fitting with adjacent similar slabs.

11. A slab according to claim 7 wherein the fastening elements are composed of mortar having the following composition:

Cement: 10 to 80 percent by weight

Sand, quartz or other mineral filler: 0 to 80 percent by weight

Synthetic plastic: 2 to 50 percent by weight.

12. A slab according to claim 11 wherein the mortar has the following composition:

Cement: 40 to 60 percent by weight

Sand, quartz or other mineral filler: 30 to 50 percent by weight

Synthetic plastic: 5 to 25 percent by weight.

13. A slab according to claim 3 in combination with a layer of synthetic-plastic-component-poor plaster or mortar which permits the passage of water vapor therethrough, the layer being in contact with the one surface, filling the grooves and covering the reinforcing web.

14. A slab according to claim 13 having a finish layer over the synthetic-plastic-component-poor plaster.

15. An insulated masonry structure, a significant surface of which is covered with slabs, each of which is a slab according to claim 13.

16. A method of making an insulated plaster facade which comprises arranging in adjacent and touching juxtaposition a series of hard-foam slabs, each of which is a slab according to claim 1, applying a layer of synthetic-plastic-poor plaster to the one surface of each slab so that the plaster contacts said one surface, fills the grooves and covers the web.

17. A method according to claim 16 wherein the reinforcing web is a web of glass-fiber fabric, the hard foam is polystyrene hard foam, the hard-foam slab has a follow-up shrinkage of at least 1 millimeter per meter, and the glass-fiber fabric is spaced from 1 to 2 millimeters from said one surface.

18. A method according to claim 17 wherein the synthetic-plastic-poor plastic contains from 0 to 2.5 percent by weight of synthetic plastic.

19. A method according to claim 18 wherein the synthetic-plastic-poor plaster contains from 0.5 to 1.5 percent by weight of synthetic plastic.

20. A method according to claim 17 wherein the fastening elements are composed of adhesive.

21. A method according to claim 20 wherein the adhesive is synthetic-plastic-rich mortar.

22. A method according to claim 17 wherein the hard-foam slabs have the largest follow-up shrinkage possible.

23. A method according to claim 17 which comprises securing the hard-foam slabs to a wall surface before applying the synthetic-plastic-poor plaster thereto.

24. A method according to claim 23 which further comprises allowing the synthetic-plastic-poor plaster to set and harden and thereafter applying a coat of mineral paint thereto.

25. A method according to claim 23 which further comprises allowing the synthetic-plastic-poor plaster to set and harden and thereafter applying a layer of hydraulically-setting plaster thereto.

26. A method according to claim 23 which further comprises allowing the synthetic-plastic-poor plaster to set and harden and thereafter applying synthetic-plastic-modified hydraulically-setting plaster or paint thereto.

27. A method of making an insulated facade which comprises arranging in adjacent and touching juxtaposition a series of hard-foam slabs, each of which is a slab according to claim 1, applying a layer of synthetic-plastic-containing mortar to the one surface of each slab so that the mortar contacts said one surface, fills the grooves and covers the web.

28. A method according to claim 27 wherein the mortar comprises cement, sand and, optionally, lime, and the synthetic plastic is methylcellulose, polyacrylate, polymethacrylate, a copolymer of acrylic acid, a copolymer of methacrylic acid, a polystyrolacrylate or a polyvinylacetate.

29. A method of making an insulated structure according to claim 15 which comprises;

(a) securing to the masonry in adjacent and touching juxtaposition a sufficient number of hard-foam slabs to cover a significant portion of a face of the masonry structure, each slab having two major surfaces, one of which has plural grooves and lands between adjacent grooves and faces away from the masonry, (b) attaching fastening elements to the lands and dispersed over said one surface, the fastening elements having a base and a head end, (c) affixing a reinforcing web to the head ends of the fastening elements so that the web is separated from said one surface by a substantially uniform distance, the fastening elements being secured to the one surface at their respective bases, (d) applying a synthetic-resin-poor plaster or mortar to said one surface so that it contacts the one surface, fills the grooves and covers the web, and (e) allowing the plaster or mortar to set and dry.

* * * * *

UNITED STATES PATENT AND TRADEMARK OFFICE

CERTIFICATE OF CORRECTION

PATENT NO. : 4,288,956

DATED : September 15, 1981

INVENTOR(S) : Friedrich Heck

It is certified that error appears in the above-identified patent and that said Letters Patent are hereby corrected as shown below:

Column 1, line 8, "say" should read --day--; line 49, "The" should read --That--. Column 5, line 21, "Adhesive" should read --Adhesives--. Column 7, line 35, "resistance from water" should read --resistance to water--. Column 9, line 8, "synthetic-plastic-poor plastic" should read --synthetic-plastic-poor plaster--.

Signed and Sealed this

*Eighth* Day of *June 1982*

[SEAL]

*Attest:*

GERALD J. MOSSINGHOFF

*Attesting Officer*

*Commissioner of Patents and Trademarks*